US006465165B2

(12) United States Patent
Landry-Coltrain et al.

(10) Patent No.: US 6,465,165 B2
(45) Date of Patent: Oct. 15, 2002

(54) SCRATCH RESISTANT-WATER RESISTANT OVERCOAT FOR PHOTOGRAPHIC SYSTEMS

(75) Inventors: Christine J. Landry-Coltrain, Fairport; Hwei-ling Yau; Linda M. Franklin, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/312,378

(22) Filed: May 14, 1999

(65) Prior Publication Data

US 2002/0076627 A1 Jun. 20, 2002

(51) Int. Cl.[7] ..... G03C 1/76

(52) U.S. Cl. ..... 430/523; 430/527; 430/530; 430/533; 430/536

(58) Field of Search ..... 430/523, 527, 430/530, 533, 536

(56) References Cited

U.S. PATENT DOCUMENTS

| | | | | | |
|---|---|---|---|---|---|
| 2,173,480 | A | | 9/1939 | Jung | |
| 2,259,009 | A | | 10/1941 | Talbot | |
| 2,331,746 | A | | 10/1943 | Talbot | |
| 2,706,686 | A | | 4/1955 | Hilborn | |
| 2,719,791 | A | | 10/1955 | Land | |
| 2,751,315 | A | | 6/1956 | Staehle | |
| 2,798,004 | A | | 7/1957 | Weigel | |
| 2,956,877 | A | | 10/1960 | Land | |
| 3,113,867 | A | | 12/1963 | Van Norman et al. | |
| 3,190,197 | A | | 6/1965 | Pinder | |
| 3,397,980 | A | | 8/1968 | Stone | |
| 3,415,670 | A | | 12/1968 | McDonald | |
| 3,443,946 | A | | 5/1969 | Grabhofer et al. | |
| 3,492,252 | A | | 1/1970 | Euchner et al. | |
| 3,502,501 | A | | 3/1970 | Burczyk et al. | |
| 3,697,277 | A | | 10/1972 | King | |
| 3,916,043 | A | * | 10/1975 | Fowble | 427/294 |
| 4,092,173 | A | | 5/1978 | Novak et al. | |
| 4,139,514 | A | | 2/1979 | Bassett | |
| 4,171,979 | A | | 10/1979 | Novak et al. | |
| 4,199,363 | A | | 4/1980 | Chen | |
| 4,279,945 | A | | 7/1981 | Audran et al. | |
| 4,302,523 | A | | 11/1981 | Audran et al. | |
| 4,333,998 | A | | 6/1982 | Leszyk | |
| 4,426,431 | A | | 1/1984 | Harasta et al. | |
| 4,560,714 | A | | 12/1985 | Gajria et al. | |
| 4,569,863 | A | * | 2/1986 | Koepke et al. | 427/402 |
| 4,733,293 | A | | 3/1988 | Gabuzda | |
| 4,999,266 | A | | 3/1991 | Platzer et al. | |
| 5,179,147 | A | | 1/1993 | Jones | |
| 5,376,434 | A | | 12/1994 | Ogawa et al. | |
| 5,447,832 | A | | 9/1995 | Wang et al. | |
| 5,698,384 | A | * | 12/1997 | Anderson et al. | 430/530 |
| 5,853,965 | A | | 12/1998 | Haydock et al. | |
| 5,856,051 | A | * | 1/1999 | Yau et al. | 430/14 |
| 5,866,282 | A | | 2/1999 | Bourdelais et al. | |
| 5,874,205 | A | | 2/1999 | Bourdelais et al. | |
| 5,875,370 | A | | 2/1999 | Patton et al. | |
| 5,888,643 | A | | 3/1999 | Aylward et al. | |
| 5,888,681 | A | | 3/1999 | Gula et al. | |
| 5,888,683 | A | * | 3/1999 | Gula et al. | 430/22 |
| 5,888,714 | A | | 3/1999 | Bourdelais et al. | |
| 5,905,924 | A | | 5/1999 | Patton et al. | |

OTHER PUBLICATIONS

H. P. Le, Progress and Trends In Ink–Jet Printing Technology.

W.E. Lee and E.R. Brown, The Developing Agents And Their Reactions, The Theory Of Photographic Process, 1977, pp. 291–327.

Werner Funke, Reactive Microgels–Polymers Intermediate In Size Between Single Molecules And Particles, 1989, pp. 107–115.

Markus Antonietti, Microgels–Polymers With A Special Molecular Architecture, 1988, pp. 1813–1817.

John L. Gardon, Emulsion Polymerization, 1977, pp. 143–197.

Research Disclosure No. 37038, Feb. 1995, Typical And Preferred Colored Paper, Color Negative, And Color Reversal Photographic Elements And Processing.

Research Disclosure No. 34390, Nov. 1992, Photographic Light–Sensitive Silver Halide Film Can Comprise A Transparent Magnetic Recording Layer, Usually Provided On The Backside Of The Photographic Support.

* cited by examiner

*Primary Examiner*—Janet Baxter
*Assistant Examiner*—Amanda C. Walke
(74) *Attorney, Agent, or Firm*—Chris P. Konkol

(57) ABSTRACT

The present invention is an imaged photographic element having a protective overcoat thereon. The protective overcoat is formed by providing a photographic element having at least one silver halide light-sensitive emulsion layer. A first coating of hydrophobic polymer particles having an average size of 0.01 to 1 microns, a melting temperature of from 55 to 200° C. at a weight percent of 30 to 95, and gelatin at a weight percent of 5 to 70 is applied to form a first layer over the silver halide light-sensitive emulsion layer. A second coating of abrasion resistant particles having an average size of from 0.01 to 1 microns is applied to form a second layer over the first layer. The photographic element is developed to provide an imaged photographic element. The first and second layers are fused to form a protective overcoat.

25 Claims, No Drawings

SCRATCH RESISTANT-WATER RESISTANT OVERCOAT FOR PHOTOGRAPHIC SYSTEMS

FIELD OF THE INVENTION

The present invention provides a protective overcoat for photographic elements. More particularly the present invention provides an overcoat which is permeable to processing solutions and when subsequently fused provides water resistance and scratch protection to photographic elements.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Gelatin has been used exclusively in a variety of silver halide photographic systems as the primary binder due to its many unique properties, one of which is the water-swellable property. This rapid swelling allows processing chemistry to proceed and images to be formed. However, due to this same property, photographic images, whether they are on film or paper, need to be handled with extreme care so as not to come in contact with any aqueous solutions that may damage the images. Thus, although gelatin, and similar natural or synthetic hydrophilic polymers, have proven to be the binders of choice for silver halide photographic elements to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009; 2,331,746; 2,798,004; 3,113,867; 3,190,197; 3,415,670 and 3,733,293. The application of UV-polymerizable monomers and oligomers on processed image followed by radiation exposure to form crosslinked protective layer is described U.S. Pat. Nos. 4,092,173; 4,171,979; 4,333,998 and 4,426,431. One drawback for the solvent coating method and the radiation cure method is the health and environmental concern of those chemicals to the coating operator. U.S. Pat. Nos. 3,397,980; 3,697,277 and 4,999,266 describe methods of laminating polymeric sheet film on the processed image as the protective layer. U.S. Pat. No. 5,447,832 describes the use of a protective layer containing mixture of high and low Tg latices as the water-resistance layer to preserve the antistat property of the $V_2O_5$, layer through photographic processing. This protective layer is not applicable to the image formation layers since it will detrimentally inhibit the photographic processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective.

U.S. Pat. No. 5,856,051 incorporated by reference herein, describes a protective overcoat comprising hydrophobic polymer particles that have a particular melting point range, and gelatin. After photoprocessing development to produce the image, the photographic element is thermally fused so that the hydrophobic polymer particles form a water-resistant protective overcoat. The element described in the '051 patent, however, suffers in that this protective overcoat is easily scratched. The present invention discloses a uniquely structured overcoat that allows the photographic processing solutions to diffuse through for image formation, and then provides water resistance and improved scratch resistance properties compared to the one described in the '051 patent.

There remains a need for an aqueous coatable, water-resistant protective overcoat that can be incorporated into the photographic product, allows for appropriate diffusion of photographic processing solutions, and does not require coating operation after exposure and processing.

SUMMARY OF THE INVENTION

The present invention is an imaged photographic element having a protective overcoat thereon. The protective overcoat is formed by providing a photographic element having at least one silver halide light-sensitive emulsion layer. A first coating of hydrophobic polymer particles having an average size of 0.01 to 1 microns, a melting temperature of from 55 to 200° C. at a weight percent of 30 to 95, and gelatin at a weight percent of 5 to 70 is applied to form a first layer over the silver halide light-sensitive emulsion layer. A second coating of abrasion resistant particles having an average size of from 0.01 to 1 microns is applied to form a second layer over the first layer. The photographic element is developed to provide an imaged photographic element. The first and second layers are fused to form a protective overcoat.

DETAILED DESCRIPTION OF THE INVENTION

The present invention describes an imaged photographic element having an overcoat that imparts both water resistance and abrasion resistance. The protective overcoat of this invention can be achieved in one of the following manners. An uppermost overcoat layer, composed of abrasion resistant particles and optionally water soluble binders and optionally a fusible wax component, is coated over a second uppermost layer, which is composed of fusible particles and gelatin as described in U.S. Pat. No. 5,856,051. This entire package can then be imaged, processed, and fused. Alternately a water resistant fusible overcoat, as described in U.S. Pat. No. 5,856,051, is coated on silver halide containing photographic products. This photographic product is imaged and processed to generate an image. The abrasion resistant overcoat layer, composed of a hard particle component and optionally water soluble binders and optionally a fusible wax component is coated over this package and dried. The entire package is then fused.

The structured overcoat of this invention is composed of hard abrasion resistant particles that are stratified in the overcoat layer and which, after fusing, provide the most effective resistance to scratches. The present invention provides scratch (abrasion) resistance to a photographic element that is water-resistant.

The present invention provides a first overcoat formulation to the emulsion side of photographic products, particularly photographic prints. The first overcoat formulation of the present invention includes 30–95% by weight (based on the dry laydown of the overcoat) of hydrophobic polymer particles having an average size of 0.01–1 microns, preferably 0.01 to 0.5 microns and 5–70% by weight (based on the dry laydown of the overcoat) of gelatin as binder. Gelatin includes lime processed gelatin, acid processed gelatin and modified gelatin as described in U.S Pat. Nos. 5,219,992 and 5,316,902. Other common addenda, such as hardeners, spreading agents, charge control agents, surfactants and lubricants can also be included in the formulation as needed. The hydrophobic polymer of this invention has melting temperature (Tm) of 55–200° C., and forms a water-resistant layer by fusing the polymer particles at a temperature above the Tm after the sample has been processed to generate the image. Since the particle size of the polymer is small, the overcoat layer will not adversely affect the sharpness of the image due to light scattering, as observed for other large particle fillers. The presence of 5–70% by weight of gelatin is sufficient to allow proper permeability for processing solution to diffuse in and out for image development and also retain particles in the layer during processing. The coating solution is aqueous and can be incorporated in the manufacturing coating operation without any equipment modification. The fusing step is simple and environmentally friendly to photofinishing laboratories. Polymer of choice can be any hydrophobic polymer or copolymer as long as the melting temperature is above 55° C. and below 200° C. The lower limit is to prevent premature coalescence from occurring prior to photographic processing, and the upper limit is to prevent destruction of the paper support and imaging chemicals during fusing. These types of hydrophobic particles (polymers) include dispersions of submicron size, from 0.01 $\mu$m to 1 $\mu$m wax particles such as those offered commercially as aqueous or non-aqueous dispersions of polyolefins, polypropylene, polyethylene, high density polyethylene, oxidized polyethylene, ethylene acrylic acid copolymers, microcrystalline wax, paraffin, and natural waxes such as carnauba wax, and aqueous dispersions of synthetic waxes from such companies as, but not limited to, Chemical Corporation of America (Chemcor), Inc., Michelman Inc., Shamrock Technologies Inc., Daniel Products Company. The dispersion may also contain dispersing aids such as polyethylene glycol.

The incorporation of water soluble polymers at 5–45% by weight based on the total dry laydown of the first layer can improve the developability and dye formation rate of the imaging formation layer, especially noticeable for the layers closer to the support. During processing, the water soluble polymers are removed from the coating and therefore do not interfere with the formation of water resistance layer by fusing treatment. The average molecular weight of the water-soluble polymers is between 1,000 and 200,000, preferably between 1,500 and 20,000. A wide variety of nonionic, anionic or cationic water soluble polymers can be used in the present invention including polyacrylamides, polymethacrylamide, poly(acrylic acid), poly(methacrylic acid), poly(ethylene oxide), poly(oxymethylene), poly(vinyl alcohol), polyvinylamine, polyvinylpyrrolidone, poly(vinyl pyridine), poly(ethylene imine), poly(ethylene glycol methacrylate), poly(hydroxyethyl methacrylate), poly(vinyl methyl ether), poly(styrene sulfonic acid), poly(ethylene sulfonic acid), poly(vinyl phosphoric acid), poly(maleic acid), or copolymers containing sufficient amount of hydrophilic functional groups to be water soluble.

The second layer of the overcoat is composed of hard abrasion resistant particles, either a sub-micron size inorganic oxide particle such as silicon oxide, aluminum oxide, titanium oxide, or a polymer or copolymer particle that is comprised of a significant amount (>40%) of a monomer precursor to a polymer having modulus that is higher than that of polyethylene and thus provides good abrasion resistance. Moduli listings for polyethylene and many polymers can be found in general plastics references such as Modern Plastics Encyclopedia, October Volume 67, number 11 (1990). Such polymers include, for example polyacrylates and polymethacrylates such as polymethyl methacrylate, polyphenylmethacrylate, polyethylmethacrylate, polymethylacrylate, and copolymers with acrylic or methacrylic acid or minor amounts of other polymeric components, cellulose esters such as cellulose diacetates and triacetates, cellulose acetate butyrate, cellulose nitrate, or sulfonates, polyesters, polyurethanes, urea resins, melamine resins, urea-formaldehyde resins, polyacetals, polybutyrals, polyvinyl alcohol, epoxies and epoxy acrylates, phenoxy resins, polycarbonates, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, vinylidine chloride-acrylonitrile-acrylic acid copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers. Polyacrylates and polymethacrylates such as polymethyl methacrylate, polyphenylmethacrylate, polyethylmethacrylate, polymethylacrylate, and copolymers with acrylic or methacrylic acid are preferred.

These hard abrasion resistant particle components can optionally contain minor amounts of hydrophilic components, such as, itaconic acid, styrene sulfonic acid, 2-acrylamido-2-methylpropane sulfonic acid-sodium salt, 2-hydroxyethyl acrylate, 2-methacryloyloxyethyl-1-sulfonic acid-sodium salt and others commonly known in the art.

These hard abrasion resistant particle components can optionally contain minor amounts of crosslinking agents such as divinyl benzene, 1,4-butyleneglycol methacrylate, trimethylpropane triacrylate, ethyleneglycol dimethacrylate and others commonly known in the art.

Other common addenda, such as hardeners, spreading agents, charge control agents, surfactants and lubricants can also be included in the formulation as needed.

The imaged photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are preferred imaged photographic elements for use in this invention.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, glass, and reflective bases such as paper, coated papers, melt-extrusion-coated paper, and laminated papers, such as biaxally oriented support laminates. Biaxally oriented support laminates are described in U.S. Pat. Nos. 5,853,965; 5,866,282; 5,874,205; 5,888,643; 5,888,681; 5,888,683; and 5,888,714 incorporated by reference herein. These biaxally oriented supports include a paper base and a biaxially oriented polyolefin sheet, typically polypropylene, laminated to one or both sides of the paper base. At least one photosensitive silver halide layer is applied to the biaxially oriented polyolefin sheet. Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The present invention is illustrated by the following Examples.

Preparation of Abrasion Resistant (AR) Particles

AR-1: a random copolymer of acrylonitrile (15%), vinylidine chloride (79%), and acrylic acid (6%) prepared by conventional latex polymerization method as described below.

To a 400 ml champagne bottle, added in order: (1) 222.5 g of demineralized water, degassed with nitrogen for 10 minutes, (2) 1.35 g of Triton-770, (3) 4.93 g of acrylic acid, (4) 12.34 g of acrylonitrile, (5) 64.96 g of vinylidene chloride, (6) 0.204 g of potassium metabisulfate, and (7) potassium persulfate. The bottle was sealed and put in a tumbler bath at 30° C. for 16–20 hours. The polymerized mixture was stripped under vacuum for 15 minutes at room temperature to remove residual volatile monomers. Glass transition temperature, as measured by DSC was 46° C. and the average particle size was 97 nm.

AR-2: a random copolymer of methyl methacrylate (98%) and [2-acrylamido-2-methylpropane sulfonic acid,-sodium salt] (2%), prepared by conventional latex polymerization method as described below.

To a 2 L three-necked reaction flask fitted with a stirrer and condenser was added 1133 ml of degassed distilled water, 12.5 ml of 40% Witconate AOS, and 0.20 g of potassium persulfate. The flask was placed in a 80° C. bath and the contents of an addition flask 98 g of methyl methacrylate and 2 g of [2-acrylamido-2-methylpropane sulfonic acid,-sodium salt] was added to the reaction flask over a period of 90 minutes. The reaction flask was stirred at 80° C. for additional 2 hours. Glass transition temperature, as measured by DSC was 120° C. and the average particle size was 45 nm.

AR-3: a random copolymer of ethyl methacrylate (95%) and [2-acrylamido-2-methylpropane sulfonic acid,-sodium salt] (5%), prepared by conventional latex polymerization method as described below.

2.5 g of Rhodacal A-246 L and 200 ml of deionized water were mixed in a 1 liter 3-neck round bottom flask equipped with a mechanical stirrer, nitrogen inlet, and a condenser. The flask was immersed in a constant temperature bath at 80° C. and purged with nitrogen for 30 minutes. 5 g of 10% sodium persulfate was added. A monomer emulsion comprising 95 g of ethyl methacrylate, 10 g of acryloamido-2-methyl-1-propanesulfonic acid(sodium salt), 2.5 g of Rhodacal A-246 L, 5.0 g of SAM 211A-80(from PPG), 10 g of 10% sodium persulate, and 200 g of deionized water was then pumped into the reactor over two hours. The latex was further heated at 80° C. for one hour. The latex was then cooled and filtered through glass wool. The final particles size was 47 nm and the % solid was 19.1%. Glass transition temperature, as measured by DSC was 73° C.

AR-4: Snowtex UP, an elongated colloidal silica from Nissan with dimensions of 5–20 nm wide and 40–300 nm long.

AR-5: a random copolymer of ethyl methacrylate (80%), ethyleneglycol dimethacrylate (10%), and methacrylic acid (10%) prepared by conventional latex polymerization method as described below.

To a 4 liter, glass reactor was added 675 g of demineralized water and 48.76 g of 30% Rhodapon UB STD. This solution was heated to 80° C. in a nitrogen atmosphere with 100 RPM stirring. To a 2 liter glass head tank was added 810 g of demineralized water, 58.52 g of 30% Rhodapon UB STD, 561.8 g of ethyl methacrylate, 70.2 g of ethylene glycol dimethacrylate, and 70.2 g of methacrylic acid. The head tank was stirred well to emulsify the ingredients. When all was ready, 2.926 g of sodium persulfate was added to the reactor. Within two minutes the monomer emulsion was started so that 1271 g of emulsion was added to the reactor over two hours. The product was then held at 80° C. for one hour followed by cooling to 60° C. In a 250 ml flask, 11.07 g of 30% hydrogen peroxide was diluted to 120 g with demineralized water. In a 20 ml vial, 0.89 g of erythorbic acid was dissolved in 20 g of demineralized water. When the reactor temperature was at 60° C. the erythorbic acid solution was added to the reactor over 10 seconds. Then 32 g of the peroxide solution was added to the reactor over 30 minutes. The product was held at 60° C. for one hour then cooled to 20° C. The % solids of the final latex was 29.40%, the average particle size was 35 nm, and the glass transition temperature, as measured by DSC, was 102° C.

AR-6: a random copolymer of methyl methacrylate (80%) ethyleneglycol dimethacrylate (10%), and methacrylic acid (10%), prepared by conventional latex polymerization method as described below.

To a 4 liter glass reactor was added 675 g of demineralized water and 48.76 g of 30% Rhodapon UB STD. This solution was heated to 80° C. in a nitrogen atmosphere with 100 RPM stirring. To a 2 liter glass head tank was added 810 g of demineralized water, 58.52 g of 30% Rhodapon UB STD, 561.8 g of methyl methacrylate, 70.2 g of ethylene glycol dimethacrylate, and 70.2 g of methacrylic acid. The head tank was stirred well to emulsify the ingredients. When all was ready, 2.926 g of sodium persulfate was added to the reactor. Within two minutes the monomer emulsion was started so that 1271 g of emulsion was added to the reactor over two hours. The product was then held at 80° C. for one hour followed by cooling to 60° C. In a 250 ml flask, 11.07 g of 30% hydrogen peroxide was diluted to 120 g with demineralized water. In a 20 ml vial, 0.89 g of erythorbic acid was dissolved in 20 g of demineralized water. When the reactor temperature was at 60° C. the erythorbic acid solution was added to the reactor over 10 seconds. Then 32 g of the peroxide solution was added to the reactor over 30 minutes. The product was held at 60° C. for one hour then cooled to 20° C. The % solids of final latex was 29.65%, the average particle size was 68 nm, and the glass transition temperature, as measured by DSC, was 126° C.

Testing Procedures

Glass Transition Temperature (Tg)

The glass transition temperature (Tg) of the dry polymer material was determined by differential scanning calorimetry (DSC), using a ramping rate of 20° C./minute. Tg is defined herein as the midpoint of the inflection in the change in heat capacity with temperature.

Particle Size Measurement

All particles were characterized by Photon Correlation Spectroscopy using a Zetasizer Model DTS5100 manufactured by Malvern Instruments. Sizes are reported as Z averages.

Tests for Water Resistance either Test 1 or Test 2 can be used to evaluate the water resistance of the element.

Test 1

Ponceau Red dye is known to stain gelatin through ionic interaction, therefore, it is used to test water resistance. The Ponceau Red dye solution was prepared by dissolving 1 gram dye in 1000 grams mixture of acetic acid and water (5 parts:95 parts). Color photographic paper samples, without being exposed to light, were processed through Kodak RA4 process to obtain white Dmin samples. These processed samples were then passed through a set of rollers under pressure and heat (fusing) to convert the polymer particles of the overcoat into a water resistant layer. The water permeability test was performed by soaking fused samples in the dye solution for 5 minutes, followed by a 30-second water rinse to remove excess dye solution on the coating surface. Each sample was air dried, and reflectance density on the soaked area was recorded. Optical density of 3 indicates a completely water permeable coating, its water resistance= 0%. Relative to an optical density of 3 being 0% water resistance and an optical density of 0 being 100% water resistant, the percent water resistance is calculated by the following equation:

$$\%\ \text{water resistance}=[1-(\text{density}/3)]\times 100$$

Test 2

The static contact angle of a drop of water deposited onto the fused photographic element is measured using a Rame-Hart NRL-CA Goniometer model #100–00. A contact angle equal to or greater than 80 degrees indicates that the water is repelled from the surface of the photographic element, rendering it water resistant. A contact angle less than 80 degrees indicates that the coatings did not provide acceptable water resistance.

Test for Dry Abrasion Resistance

A two-ply general purpose paper towel, with a 200 g weight on top, was pulled across the sample surface 8 times. The bottle shaped 200 g class M2 weight had a 3 cm diameter which resulted in a 7.1 $cm^2$ contact area between the towel and the sample. The sample was then visually ranked on a scale from 0 to 10, depending on the frequency and depth of the resulting scratches. A ranking of 10 indicates excellent performance with no visible damage, while a ranking of 0 indicated very poor performance with the surface totally abraded and worn.

Scratch Resistance Rankings

0 Totally abraded/worn
1 Dense scratches with associated haze band
2 Numerous scratches with associated haze band
3 Few scratches with associated haze band
4 Dense, heavy scratches
5 Numerous, heavy scratches
6 Few, heavy scratches
7 Dense, heavy scratches
8 Numerous, light scratches
9 Few, light scratches
10 No visible damage

EXAMPLE 1

Preparation of Sample No. 1 (Comparison Example that has no Water Resistance)

Sample No. 1 was prepared by coating in sequence blue-light sensitive layer, interlayer, green-light sensitive layer, UV layer, red-light sensitive layer, UV layer and overcoat on photographic paper support. The components in each individual layer is described below.

| Layer | Laydown (mg/sq.ft.) |
|---|---|
| Overcoat | 120.0 gelatin |
| | 1.0 SURF-1 |
| | 0.39 SURF-2 |
| | 8.87 HAR-1 |
| UV | 12.11 UV-1 |
| | 2.13 UV-2 |
| | 3.57 SCV-1 |
| | 2.37 S-1 |
| | 2.37 S-2 |
| | 47.5 Gelatin |
| Cyan | 18.1 Red light sensitive AgX |
| | 39.31 C-1 |
| | 38.52 S-2 |
| | 3.22 S-3 |
| | 25.31 UV-1 |
| | 129.0 Gelatin |
| UV | 17.43 UV-1 |
| | 3.07 UV-2 |
| | 5.14 SCV-1 |
| | 3.41 S-1 |
| | 3.41 S-2 |
| | 68.4 Gelatin |
| Magenta | 7.70 Green-light sensitive AgX |
| | 1.11 KCL |
| | 29.5 C-2 |
| | 8.26 S-2 |
| | 3.54 S-4 |
| | 17.7 ST-1 |
| | 2.01 ST-2 |
| | 57.0 ST-3 |
| | 0.05 FOG-1 |
| | 0.285 Nitric Acid |
| | 117.0 Gelatin |
| IL | 6.12 SCV-1 |
| | 18.4 S-2 |
| | 6.025 3,5-Disulfocatechol disodium salt |
| | 0.524 Nitric Acid |

-continued

| | |
|---|---|
| | 0.18 SURF-1 |
| | 70.0 Gelatin |
| Yellow | 24.0 Blue-light sensitive AgX |
| | 45.0 C-3 |
| | 45.0 P-1 |
| | 20.3 S-2 |
| | 0.88 SCV-2 |
| | 141.8 Gelatin |

Photographic paper support
sublayer 1: resin coat (Titanox and optic brightener in polyethylene)
sublayer 2: paper
sublayer 3: resin coat (polyethylene)

C-1 Butanamide 2-[2,4-bis(1,1-dimethylpropyl)phenoxy]-N-(3,5-dichloro-4-ethyl-2-hydroxyphenyl)

C-2

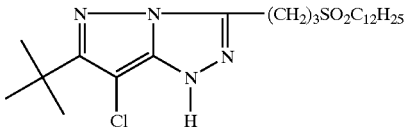

C-3

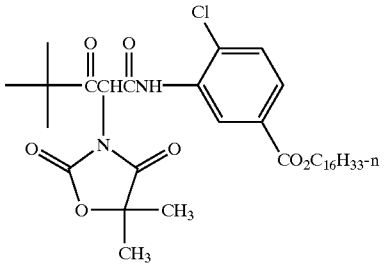

FOG-1

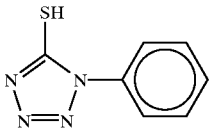

HAR-1

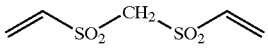

P-1

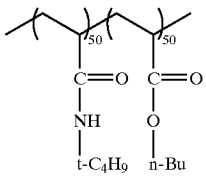

S-1 1,4-Cyclohexylenedimethylene bis(2-ethylhexaneoate)

S-2

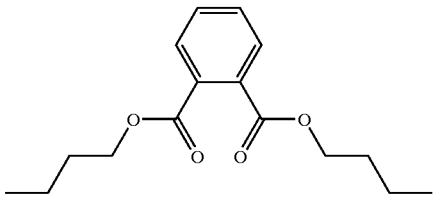

S-3 2-(2-Butoxyethoxy)ethyl acetate

S-4 Di-undecylphthalate

-continued

SCV-1

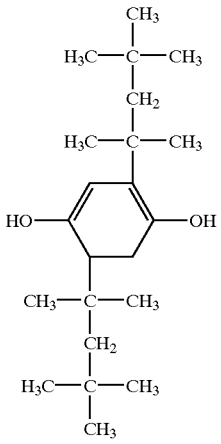

SCV-2 benzenesulfonic acid 2,5-dihydroxy-4-(1-methylheptadecyl)-mono-potassium salt

ST-1

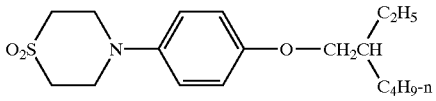

ST-2

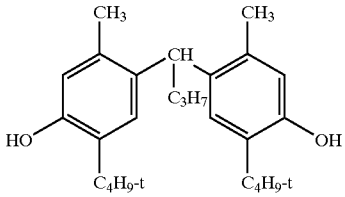

ST-3

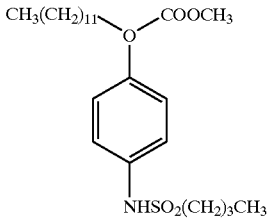

SURF-1

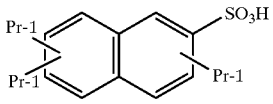

.1 Na

SURF-2 $C_8F_{17}SO_3N(C_2H_5)_4$

UV-1

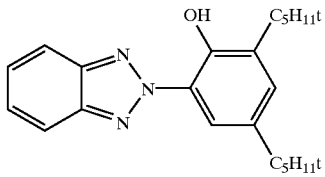

-continued

UV-2

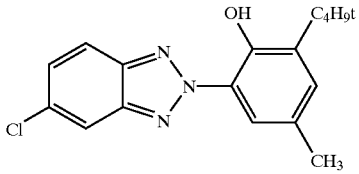

No fusible water-resistant overcoats, such as described U.S. Pat. No. 5,856,051 of this invention were coated onto this photographic element. The photographic element then underwent photographic imaging and photographic processing to develop the image. After the imaged element was dried, it was fused between rollers, at least one of which was heated at a temperature of 320° F., at a speed of 1.0 inch per second (ips).

The element was then tested for water resistance using both Test 1 and Test 2 and dry abrasion resistance, as described above. The photographic element underwent complete color change to red due to staining of the Ponceau Red dye, with a % water resistance calculated to be 2%. The water contact angle was 69°. The dry abrasion resistance was given a ranking of 6.

Preparation of Sample No. 2 (Comparison Example of Water Resistant Overcoat with Poor Abrasion Resistance)

As described in U.S. Pat. No. 5,856,051, the (water-resistant fusible) hydrophobic polymer can be any hydrophobic polymer or copolymer that has a melting temperature above 55° C. and below 200° C. These types of hydrophobic polymers include dispersions of submicron size (0.01 micron to about 1 micron) wax particles such as those offered commercially as aqueous or non-aqueous dispersions of polyolefins, polypropylene, polyethylene, high density polyethylene, oxidized polyethylene, ethylene acrylic acid copolymers, microcrystalline wax, paraffin, and natural waxes such as carnauba wax, and synthetic waxes from such companies as, but not limited to, Chemical Corporation of America (Chemcor), Inc., Michelman Inc., Shamrock Technologies Inc., Daniel Products Company, and S C Johnson. The dispersion may also include dispersing aids such as polyethylene glycol.

Sample No. 2, a reproduction of prior art described in U.S. Pat. No. 5,856,051, was prepared identical to Sample 1 in every layer, except that the 120 mg/ft$^2$ gelatin in the overcoat was replaced by 40 mg/ft$^2$ gelatin and 160 mg/ft$^2$ Jonwax 26 polyethylene emulsion (particle size is 50 nm and Tm=130° C., available from S C Johnson as aqueous dispersion at 25% solids).

The (water-permeable) gelatin binder component includes lime processed gelatin, acid processed gelatin and modified gelatin or synthetic polymers as gelatin replacement.

Other addenda, including hardeners, spreading agents, charge control agents, biocides, lubricants may also be included.

This photographic element then underwent photographic imaging and photographic processing to develop the image. After the imaged element was dried, it was fused between heated rollers, at least one of which was heated at a temperature of 320° F., at a speed of 1.0 ips.

The element was then tested for water resistance and dry abrasion resistance as used for Sample No. 1. No red color was obtained from the application of Ponceau Red dye, with the % water resistance calculated to be 95%, and the water contact angle 88°, indicating good water resistance. The dry abrasion resistance was given a ranking of 2, indicating poor performance.

Preparation of Sample No. 3 (Example of this Invention)

Sample No. 3 was prepared identical to Sample No.2, except an additional layer (secondary overcoat) was coated on top of the overcoat (farthest from the support). This secondary overcoat consists of 25 mg/ft$^2$ Snowtex UP (colloidal silica available from Nissan Chemical, particle size is 5–20 nm wide and 40–300 nm long), 5 mg/ft$^2$ gelatin, 5 mg/ft$^2$ Jonwax 26, The photographic element then underwent photographic imaging and photographic processing to develop the image. After the imaged element was dried, it was fused between rollers, at least one of which was heated, at a temperature of 320° F. and a speed of 1.0 ips.

The element was then tested for water resistance using both Test 1 and Test 2. No red color was obtained from the application of Ponceau Red dye, with the % water resistance calculated to be 95%, and the water contact angle 89°. The dry abrasion resistance was given a ranking of 7 in the Dmax area, substantially greater than the Control Sample No.2 with no secondary overcoat.

Preparation of Samples No. 4–18 (Examples of this Invention)

Samples No.4 to No. 18 were prepared identical to Sample No.3, with the difference in the composition of the outermost layer on the emulsion side. These are listed in Table 1.

The photographic elements then underwent photographic imaging and photographic processing to develop the image. After the imaged element was dried, it was fused between rollers, at least one of which was heated at a temperature of 320° F. and a speed of 1.0 ips.

The elements were then tested for water resistance using both Tests 1 and 2, and for abrasion resistance. The results are tabulated in Table 1.

Preparation of Samples No. 19–20 (Examples of this Invention)

Samples 19 and 20 were prepared similar to Sample No. 3, except the primary overcoat consists of 120 mg/ft$^2$ Jonwax 26 polyethylene emulsion instead of 160 mg/ft$^2$. Over this primary overcoat was coated a secondary overcoat so that this secondary overcoat was farthest from the support as described for Sample 3 and is composed of the components and amounts listed in Table 1.

The photographic elements then underwent photographic imaging and photographic processing to develop the image. After the imaged element was dried, it was fused between rollers, at least one of which was heated, at a temperature of 320° F. and a speed of 1.0 ips.

The elements were then tested for water resistance using both Tests 1 and 2, and for abrasion resistance. The results are tabulated in Table 1.

Preparation of Samples No. 21–23 (Examples of this Invention)

Samples 21 through 23 were prepared similar to Sample No. 3, except the primary overcoat consists of 120 mg/ft$^2$ Jonwax 26 polyethylene emulsion instead of 160 mg/ft$^2$. Over this primary overcoat was coated a secondary overcoat so that this secondary overcoat was farthest from the support as described for Sample 3 with the difference in the composition of the outermost layer and is composed of the components and amounts listed in Table 1. No gelatin and no Jonwax 26 were added to this secondary overcoat.

The photographic elements then underwent photographic imaging and photographic processing to develop the image. After the imaged element was dried, it was fused between rollers, at least one of which was heated, at a temperature of 320° F. and a speed of 1.0 ips.

The elements were then tested for water resistance using Test No. 1 and for abrasion resistance. The results are tabulated in Table 1.

TABLE 1

| | Secondary Overcoat Composition (mg/sft) | | | % water resistance after fusing | Contact angle | Dry Abrasion |
|---|---|---|---|---|---|---|
| Sample ID | particle ID | gelatin | Jonwax 26 | (Test 1) | (Test 2) | Ranking |
| 2 (comparison) | 0 | 0 | 0 | 95 | 88 | 2 |
| 3 (Invention) | AR-4 (@25 mg) | 5 | 5 | 95 | 89 | 7 |
| 4 (Invention) | AR-4 (@25 mg) | 10 | 5 | 95 | 90 | 8 |
| 5 (Invention) | AR-4 (@25 mg) | 5 | 10 | 95 | 89 | 7 |
| 6 (Invention) | AR-4 (@20 mg) | 10 | 10 | 95 | 88 | 7 |
| 7 (Invention) | AR-4 (@20 mg) | 10 | 20 | 94 | 86 | 7 |
| 8 (Invention) | AR-4 (@30 mg) | 16 | 0 | 84 | 89 | 9 |
| 9 (Invention) | AR-4 (@30 mg) | 8 | 0 | 94 | 90 | 7 |
| 10 (Invention) | AR-4 (@30 mg) | 4 | 0 | 95 | 88 | 7 |
| 11 (Invention) | AR-3 (@30 mg) | 2 | 0 | 95 | 82 | 8 |
| 12 (Invention) | AR-3 (@30 mg) | 4 | 0 | 93 | 80 | 7 |
| 13 (Invention) | AR-3 (@30 mg) | 8 | 0 | 79 | 88 | 8 |
| 14 (Invention) | AR-3 (@30 mg) | 16 | 0 | 73 | 80 | 9 |
| 15 (Invention) | AR-3 (@20 mg) | 10 | 20 | 94 | 85 | 7 |

TABLE 1-continued

| Sample ID | Secondary Overcoat Composition (mg/sft) particle ID | gelatin | Jonwax 26 | % water resistance after fusing (Test 1) | Contact angle (Test 2) | Dry Abrasion Ranking |
|---|---|---|---|---|---|---|
| 16 (Invention) | AR-3 (@20 mg) | 10 | 10 | 83 | 90 | 9 |
| 17 (Invention) | AR-3 (@25 mg) | 5 | 10 | 85 | 90 | 9 |
| 18 (Invention) | AR-3 (@25 mg) | 10 | 5 | 76 | 83 | 9 |
| 19 (Invention) | AR-4 (@36 mg) | 4 | 0 | 94 | 86 | 10 |
| 20 (Invention) | AR-3 (@36 mg) | 4 | 0 | 84 | 80 | 7 |
| 21 (Invention) | AR-5 (@40 mg) | 0 | 0 | 97 | | 8 |
| 22 (Invention) | AR-6 (@40 mg) | 0 | 0 | 97 | | 9 |
| 23 (Invention) | AR-6 (@10 mg) | 0 | 0 | 97 | | 10 |

As shown in Table 1, the novel structure of this invention (demonstrated by Samples 3 to 23) offers water resistance as well as abrasion resistance after being fused. This is clearly an improvement over Control Sample 2, which does not give satisfactory abrasion resistance property.

EXAMPLE 2

Preparation of Samples 24–31 (Examples of this Invention)

Control Sample No. 2 was prepared (see preparation in the previous section), then underwent photographic imaging and photographic processing to develop the image. Samples 24 to 31 were prepared by coating onto Sample No. 2 a secondary overcoat so that this secondary overcoat is farthest from the support as described in Example 1 and consists of the components and amounts listed in Table 2. The entire element was then dried and fused between rollers, at least one of which was heated, at a temperature of 311° F. and a speed of 0.43 ips.

In contrast to Samples 3 to sample 23, where the secondary overcoat was applied prior to photographic processing, the secondary overcoat for Samples 24 to 31 was applied after photographic processing.

The elements were then tested for water resistance using both Test 1 and 2, and for abrasion resistance. The results are tabulated in Table 2.

As demonstrated by Example 1 and Example 2, there are at least two ways to prepare the novel structure of this invention. Samples provide improved abrasion resistance while maintaining water resistance compared to Sample No. 2, regardless of the method of preparation.

EXAMPLE 3

Preparation of Samples No. 32 to 37 (Examples of this Invention)

Control Sample No. 2 was prepared (see preparation in the previous section), then underwent photographic imaging and photographic processing to develop the image. Onto Sample No. 2 was coated a secondary overcoat so that this secondary overcoat is farthest from the support as described in Example 1 and is composed of the components and amounts listed in Table 3. The entire element was then dried and fused between rollers, at least one of which heated, at a temperature of 311° F. and a speed of 0.43 ips.

In contrast to samples described in Example 2, Samples 32 to 37 were prepared with more than one abrasion resistant particle in the secondary overcoat or with a small amount of gelatin.

The elements were then tested for water resistance using both Test 1 and 2, and for abrasion resistance. The results are tabulated in Table 3.

TABLE 2

| Sample ID | secondary overcoat composition particle | mg/ft$^2$ | % water resistance after fusing (Test 1) | Contact angle (Test 2) | Abrasion ranking Dmax |
|---|---|---|---|---|---|
| 2 (comparison) | none | | 95 | 88 | 2 |
| 24 (invention) | AR-4 | 10 | 95 | 86 | 8 |
| 25 (invention) | AR-4 | 20 | 95 | 89 | 7 |
| 26 (invention) | AR-1 | 10 | 95 | 86 | 8 |
| 27 (invention) | AR-1 | 20 | 96 | 89 | 8 |
| 28 (invention) | AR-2 | 10 | 94 | 85 | 8 |
| 29 (invention) | AR-2 | 20 | 96 | 87 | 8 |
| 30 (invention) | AR-3 | 10 | 95 | 90 | 7 |
| 31 (invention) | AR-3 | 20 | 95 | 92 | 6 |

TABLE 3

| Sample ID | secondary overcoat composition material | mg/ft$^2$ | % water resistance after fusing (Test 1) | Contact angle (Test 2) | Abrasion ranking |
|---|---|---|---|---|---|
| 2 (comparison) | none | | 95 | 88 | 2 |
| 32 | AR-2 | 18 | 95 | 84 | 9 |
| (invention) | AR-1 | 2 | | | |
| 33 | AR-2 | 14 | 95 | 88 | 7 |
| (invention) | AR-1 | 6 | | | |
| 34 | AR-2 | 10 | 95 | 90 | 7 |
| (invention) | AR-1 | 10 | | | |
| 35 | AR-2 | 14 | 95 | 88 | 7 |
| (invention) | AR-4 | 6 | | | |
| 36 | AR-2 | 18 | 95 | 90 | 8 |
| (invention) | gelatin | 2 | | | |
| 37 | AR-2 | 15 | 95 | 90 | 9 |
| (invention) | gelatin | 5 | | | |

As shown in Table 3, the combination of more than one type of abrasion resistant particle used in the secondary overcoat layer can provide the same desirable properties, such as water resistance and abrasion resistance, as the examples using only single type of abrasion resistant particle. Also, a small amount of gelatin can also be used as the binder in the secondary overcoat layer without deteriorating the water resistant property after being fused.

EXAMPLE 4

Preparation of Control Samples 38–41 (Comparative Examples)

Samples 38 to 41 were prepared similar to Sample 2, except the difference in overcoat composition. No secondary overcoat was applied to these samples. The composition of these samples are described in Table 4.

TABLE 4

| Sample ID | Overcoat Composition Material | mg/ft$^2$ |
|---|---|---|
| 2 | Jonwax 26 | 160 |
| (comparison) | Gelatin | 40 |
| 38 | Jonwax 26 | 140 |
| (comparison) | AR-3 | 20 |
| | Gelatin | 40 |
| 39 | Jonwax 26 | 120 |
| (comparison) | AR-3 | 40 |
| | Gelatin | 40 |
| 40 | Jonwax 26 | 140 |
| (comparison) | AR-2 | 20 |
| | Gelatin | 40 |
| 41 | Jonwax 26 | 120 |
| (comparison) | AR-2 | 40 |
| | Gelatin | 40 |

In contrast to the samples of this invention (No. 3 to No. 37), where abrasion resistant particles were coated in a separate layer on top of the fusible overcoat, Samples 38 to 41 had the abrasion resistant particles coated in the same layer with the fusible wax particles. These samples were imaged, processed, fused and tested as described in Examples 1, 2 and 3. Results indicated Samples 38 to 41 performed identical to Sample 2 for both water resistance and abrasion resistance properties. No noticeable improvement was observed by the addition of abrasion resistant particles.

The water resistant protective overcoat described in U.S. Pat. No. 5,856,051, provides good water resistance to a photographic element after the package is fused. However, because of the nature of the components that are needed to provide good water resistance, this overcoat is soft and prone to severe damage due to abrasion and scratches. Incorporating a hard particle component directly into this water resistant overcoat improves the scratch resistance only marginally as shown by the Comparison Examples. It is believed that when the hard abrasion resistant particles are introduced into the overcoat layer, they are distributed homogeneously throughout the entire layer. Upon fusing, water resistance is obtained; however, not enough particles reside at the surface where they would be most effective for abrasion resistance. When high levels of hard particles are introduced to the overcoat formula in the attempt to enhance its abrasion resistance property, other undesirable concerns arise. Such problems include a loss of developing speed and a loss of fusability. However, by ensuring that the hard component is concentrated close to the upper surface allows one to minimize its relative amount compared to the fusible wax particles and the water-permeable binder, and effectively enhances the abrasion resistance of the overcoat significantly.

EXAMPLE 5

Preparation of Control Sample 42 (Comparative Example with Poor Water Resistance)

Control Sample No. 1 was prepared (see preparation in the previous section), then underwent photographic imaging and photographic processing to develop the image. Sample 42 was prepared by coating onto Sample No. 1 a secondary overcoat so that this secondary overcoat is farthest from the support and contains of 20 mg/ft$^2$ of AR-2. The entire element was then dried and fused between rollers, at least one of which was heated, at a temperature of 320° F. and a speed of 0.43 ips.

The element was then tested for water resistance and dry abrasion resistance as used for Sample No. 1. The application of Ponceau Red dye resulted in total red dye stain, with the % water resistance calculated to be 63%, indicating poor water resistance. The dry abrasion resistance was given a ranking of 8, indicating good abrasion performance.

In contrast to Samples 3 to 37, where the both an overcoat containing a hydrophobic polymer and a secondary overcoat containing the abrasion resistant particles were present, no hydrophobic polymer (such as Jonwax 26) was added to the overcoat of comparison Sample 42, resulting in poor water resistance. This demonstrates that both the overcoat containing the hydrophobic polymer and the secondary overcoat containing the abrasion resistant particles are necessary for this invention.

EXAMPLE 6

Preparation of Control Sample 43 (Comparative Example with Poor Water Resistance)

Sample No. 43 was prepared by coating in sequence blue-light sensitive layer, interlayer, green-light sensitive layer, UV layer, red-light sensitive layer, UV layer and overcoat on photographic paper support. The components in each individual layer is described below.

Blue Sensitive Emulsion (Blue EM-1)

A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 μm.The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1)

A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 μm in edgelength size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1)

A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 μm in edgelength size. The emulsion is optimally sensitized by the addition of glutaryldiaminophenyldisulfide, sodium thiosulfate, tripotassium bis {2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known to the art and the following layers were coated on the following support:

The following light sensitive silver halide imaging layers were utilized to prepare photographic print materials for the invention. The following imaging layers were coated utilizing curtain coating.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | S-4 | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | S-4 | 10.40 |
| | ST-21 | 3.698 |
| | ST-22 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | S-4 | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | S-6 | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | S-6 | 7.404 |

-continued
| | | |
|---|---|---|
| | 5-chloro-2-methyl-4-isothiazolin-3-one/2-methyl-4-isothiazolin-3-one(3/1) | 0.009 |
| Layer 7 | SOC | |
| | Gelatin | 59.98 |
| | Ludox AM ™ (colloidal silica) | 14.99 |
| | Polydimethylsiloxane (DC200 ™) | 1.877 |
| | 5-chloro-2-methyl-4-isothiazolin-3-one/2-methyl-4-isothiazolin-3-one(3/1) | 0.009 |
| | SF-2 | 0.297 |
| | Tergitol 15-S-5 ™ (surfactant) | 0.186 |
| | SF-1 | 0.753 |
| | Aerosol OT ™ (surfactant) | 0.269 |
IC-35
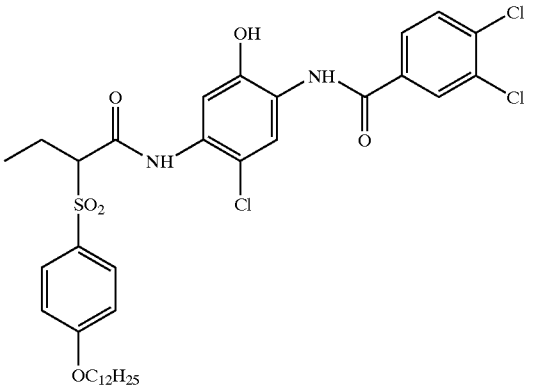
IC-36
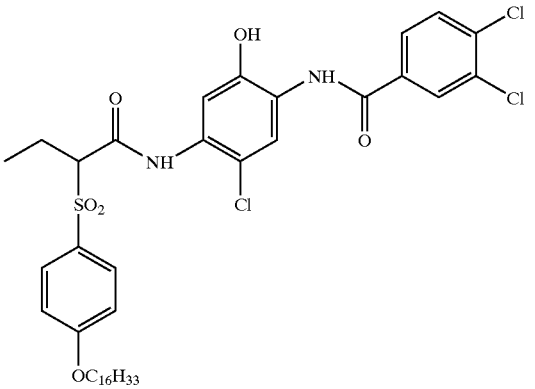
M-4
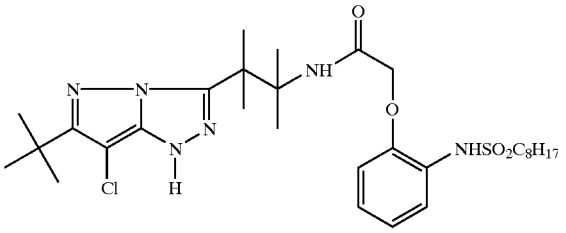
-continued
Y-4
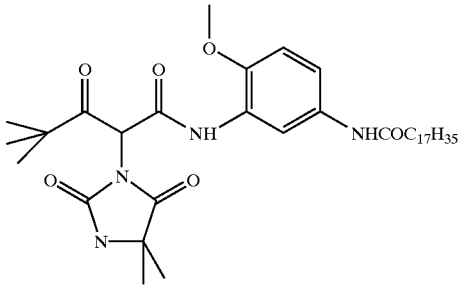
ST-16
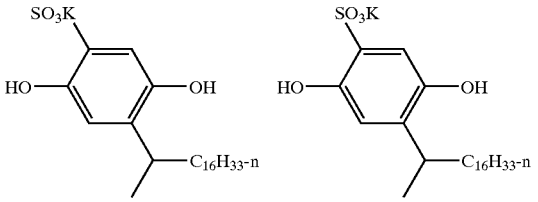
ST-4
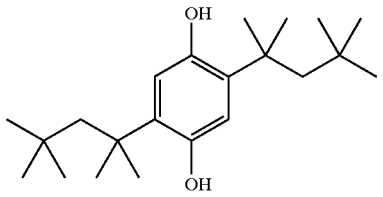
ST-21
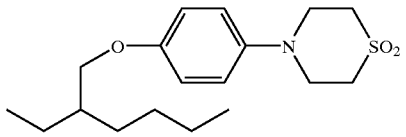
ST-22
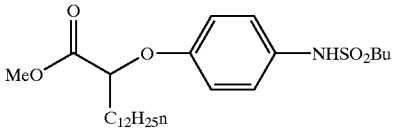
ST-23
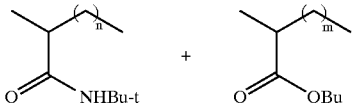
n:m 1:1 mw = 75–100,000

-continued

ST-24

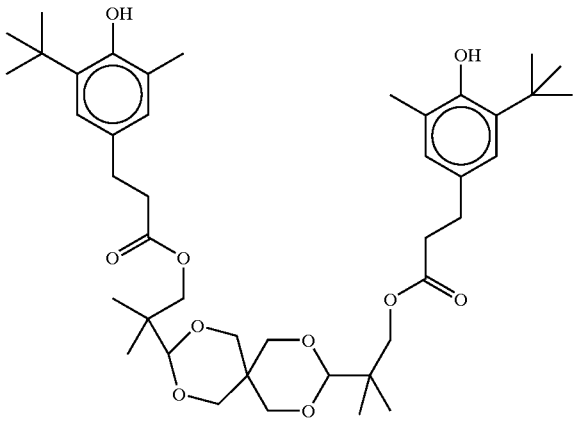

UV-1

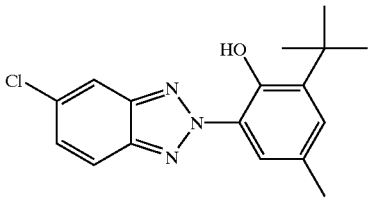

UV-2

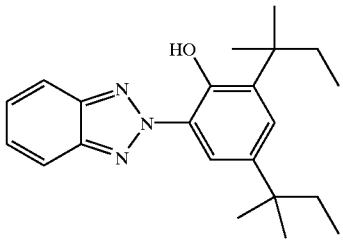

SF-1

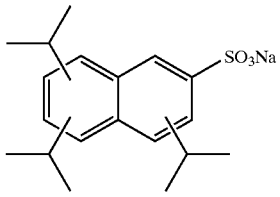

$CF_3.(CF_2)_7.SO_3NA$

S-4 = Diundecyl phthalate

S-6 = Tris(2-ethylhexyl)phosphate

SF-2

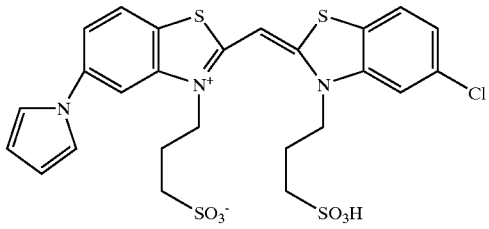

BDS-4

-continued

GSD-1

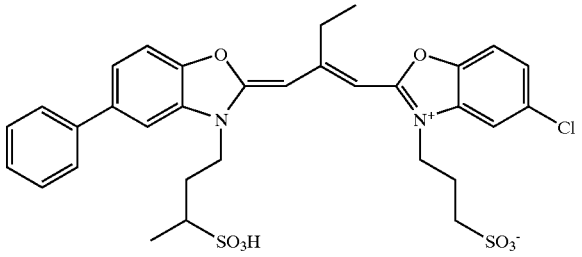

RSD-1

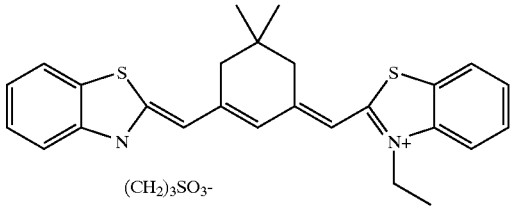

DYE-1

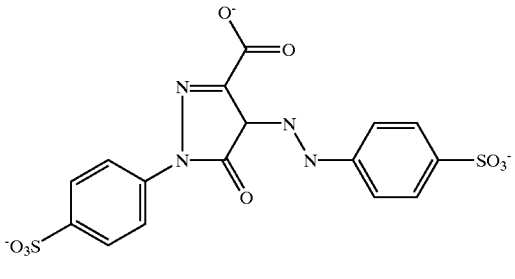

DYE-2

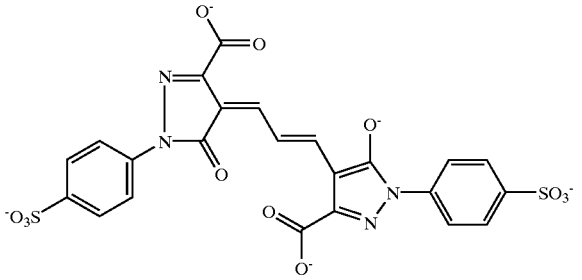

DYE-3

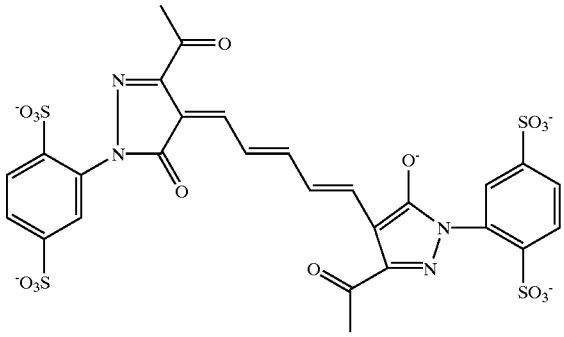

No fusible water-resistant overcoats, such as described U.S. Pat. No. 5,856,051 of this invention were coated onto this photographic element. The photographic element then underwent photographic imaging and photographic processing to develop the image. After the imaged element was dried, it was fused between rollers, at least one of which was heated at a temperature of 320° F., at a speed of 0.43 inch per second (ips).

The element was then tested for water resistance and dry abrasion resistance, as described above. The photographic element underwent complete color change to red due to staining of the Ponceau Red dye, indicating poor water resistance. The dry abrasion resistance was given a ranking of 9.

Preparation of Sample No. 44 (Comparison Example of Water Resistant Overcoat with Poor Abrasion Resistance)

Sample No. 44, a reproduction of prior art described in U.S. Pat. No. 5,856,051, was prepared identical to Sample 43 in every layer, except an additional 160 mg/ft$^2$ Jonwax 26 polyethylene emulsion (particle size is 50 nm and Tm=130° C., available from S C Johnson as aqueous dispersion at 25% solids) and 40 mg/ft$^2$ gelatin was added as the outermost layer.

The (water-permeable) gelatin binder component includes lime processed gelatin, acid processed gelatin and modified gelatin or synthetic polymers as gelatin replacement.

Other addenda, including hardeners, spreading agents, charge control agents, biocides, lubricants may also be included.

This dried, imaged and photo-processed sample was fused between heated rollers, at least one of which was heated at a temperature of 320° F., at a speed of 0.43 ips.

The element was then tested for water resistance and dry abrasion resistance as used for Sample No. 43. No red color was obtained from the application of Ponceau Red dye, indicating good water resistance. The dry abrasion resistance was given a ranking of 2, indicating poor performance.

Preparation of sample No. 45 (Example of this Invention)

Sample No. 45 was prepared identical to Sample No.44, except an additional layer (secondary overcoat) was coated on top of the overcoat (farthest from the support). This secondary overcoat consists of 20 mg/ft$^2$ AR-3.

This dried, imaged and photo-processed sample was fused between heated rollers, at least one of which was heated at a temperature of 320° F., at a speed of 0.43 ips.

The element was then tested for water resistance and dry abrasion resistance. No red color was obtained from the application of Ponceau Red dye, indicating good water resistance. The dry abrasion resistance was given a ranking of 8 in the Dmax area, substantially greater than the control Sample No.44 with no secondary overcoat.

The invention has been described in detail with particular reference to certain preferred embodiments thereof, but it will be understood that variations and modifications can be effected within the spirit and scope of the invention.

What is claimed is:

1. An imaged photographic element having a water-resistant protective overcoat thereon, the protective overcoat formed by the steps comprising;

providing a photographic element having at least one silver halide light-sensitive emulsion layer and, over the at least one silver halide light-sensitive emulsion layer, a first layer comprising hydrophobic polymer particles having an average size of 0.01 to 1 microns, a melting temperature of from 55 to 200° C. at a weight percent of 30 to 95, and gelatin at a weight percent of 5 to 70; and, over the first layer, a second layer comprising abrasion resistant particles having an average size of from 0.01 to 1 microns, wherein the first layer and second layer allow permeability for processing solution to diffuse in and out for image development;

imagewise exposing the photographic element to light;

developing the at least one silver halide light sensitive emulsion layer to provide an imaged photographic element; and fusing the first and second layers to form a water-resistant protective overcoat.

2. The imaged photographic element of claim 1 wherein the fusing comprises the application of heat.

3. The imaged photographic element of claim 1 wherein the fusing comprises the application of heat and pressure.

4. The imaged photographic element of claim 1 wherein the size of hydrophobic polymer particles is between 0.01 and 0.5 microns.

5. The imaged photographic element of claim 1 wherein the hydrophobic polymer particles comprise a polymer selected from the group consisting of polyolefins, polypropylenes, polyethylenes, high density polyethylenes, oxidized polyethylenes, ethylene acrylic acid copolymers, microcrystalline waxes, paraffin, and natural waxes.

6. The imaged photographic element of claim 1 wherein the first coating further comprises water soluble polymers at 5 to 45% by weight based on a total dry laydown of the first layer.

7. The imaged photographic element of claim 6 wherein the water soluble polymers comprise polyacrylamides, polymethacrylamides, poly(acrylic acid), poly(methacrylic acid), poly(ethylene oxide), poly(oxymethylene), poly(vinyl alcohol), polyvinylamine, polyvinylpyrrolidone, poly(vinyl pyridine), poly(ethylene imine), poly(ethylene glycol methacrylate), poly(hydroxyethyl methacrylate), poly(vinyl methyl ether), poly(styrene sulfonic acid), poly(ethylene sulfonic acid), poly(vinyl phosphoric acid) or poly(maleic acid).

8. The imaged photographic element of claim 6 wherein the water soluble polymer materials have a molecular weight of from 1,000 to 200,000.

9. The imaged photographic element of claim 1 wherein abrasion resistant particles comprise inorganic oxide particles or polymer comprised of a greater than 40 percent of a monomer precursor having modulus that is higher than that of polyethylene.

10. The imaged photographic element of claim 9 wherein the abrasion resistant particles comprise polyacrylates, polymethacrylates, cellulose esters, sulfonates, polyesters, polyurethanes, urea resins, melamine resins, urea-formaldehyde resins, polyacetals polybutyrals, polyvinyl alcohol, epoxies, epoxy acrylates, phenoxy resins, polycarbonates, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, vinylidine chloride-acrylonitrile-acrylic acid copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers.

11. The imaged photographic element of claim 1 wherein the at least one silver halide emulsion layer is applied simultaneously with the first layer and the second layer.

12. The imaged photographic element of claim 1 wherein the second coating composition further comprises hydrophobic polymer particles.

13. The imaged photographic element of claim 1 wherein the second coating composition further comprises water soluble polymers.

14. An imaged photographic element having a water-resistant protective overcoat thereon, the protective overcoat formed by the steps comprising;

providing a photographic element having at least one silver halide light-sensitive emulsion layer;

applying a first coating comprising hydrophobic polymer particles having an average size of 0.01 to 1 microns, a melting temperature of from 55 to 200° C. at a weight percent of 30 to 95, and gelatin at a weight percent of 5 to 70 to form a first layer over the at least one silver halide light-sensitive emulsion layer;

imagewise exposing the photographic element to light;

developing the at least one silver halide light sensitive emulsion layer to provide an imaged photographic element;

applying a second coating in which particles are present and consist essentially of non-conductive abrasion resistant particles having an average size of from 0.01 to 1 microns to form a second layer over the first layer; and fusing the first and second layers to form a water-resistant protective overcoat.

15. A photographic element comprising;

a support;

at least one silver halide light-sensitive emulsion layer superposed on a side of the support;

a first layer overlying the at least one silver halide emulsion layer comprising hydrophobic polymer particles having an average size of 0.01 to 1.0 microns, a melting temperature of from 55 to 200° C. at a weight percent of 30 to 95, and gelatin at a weight percent of 5 to 70;

a second layer overlying the first layer in which particles are present and consist essentially of polymer particles for providing abrasion resistance which particles have an average size of from 0.01 to 1 microns and comprise greater than 40 percent of a monomer precursor having modulus that is higher than that of polyethylene.

16. The photographic element of claim 15 wherein the hydrophobic polymer particles comprise a polymer selected from the group consisting of polyolefins, polypropylenes, polyethylenes, ethylene acrylic acid copolymers, microcrystalline waxes, paraffin, and natural waxes.

17. The imaged photographic element of claim 15 wherein the abrasion resistant particles comprise polyacrylates, polymethacrylates, cellulose esters, sulfonates, polyesters, polyurethanes, urea resins, melamine resins, urea-formaldehyde resins, polyacetals, polybutyrals, polyvinyl alcohol, epoxies, epoxy acrylates, phenoxy resins, polycarbonates, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, vinylidine chloride-acrylonitrile-acrylic acid copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers.

18. A method of making a water-resistant photographic print comprising:

(a) providing a photographic element comprising a support, a silver-halide emulsion layer superposed on a side of said support a processing-solution-permeable coating overlying the silver-halide emulsion layer, said coating comprising a first layer comprising hydrophobic polymer particles having an average size of 0.01 to 1 microns, a melting temperature of from 55 to 200° C. at a weight percent of 30 to 95, and gelatin at a weight percent of 5 to 70 and a second layer comprising abrasion-resistant particles having an average size of from 0.01 to 1 microns, wherein the first layer and second layer allow permeability for processing solution to diffuse in and out for image development;

(b) imagewise exposing the photographic element to light;

(c) developing the at least one silver halide light sensitive emulsion layer to obtain an imaged photographic element; and (d) fusing the first and second layers together to form a water-resistant protective overcoat.

19. The method of claim 18 wherein the fusing comprises the application of heat and pressure.

20. The method of claim 18 wherein the size of hydrophobic polymer particles is between 0.01 and 0.5 microns.

21. The method of claim 18 wherein the hydrophobic polymer particles comprise a polymer selected from the group consisting of polyolefins, polypropylenes, polyethylenes, high density polyethylenes, oxidized polyethylenes, ethylene acrylic acid copolymers, microcrystalline waxes, paraffin, and natural waxes.

22. The method of claim 18 wherein the first coating further comprises water soluble polymers at 5 to 45% by weight based on a total dry laydown of the first layer.

23. The method of claim 22 wherein the water soluble polymers comprise polyacrylamides, polymethacrylamides, poly(acrylic acid), poly(methacrylic acid), poly(ethylene oxide), poly(oxymethylene), poly(vinyl alcohol), polyvinylamine, polyvinylpyrrolidone, poly(vinyl pyridine), poly(ethylene imine), poly(ethylene glycol methacrylate), poly(hydroxyethyl methacrylate), poly(vinyl methyl ether), poly(styrene sulfonic acid), poly(ethylene sulfonic acid), poly(vinyl phosphoric acid) or poly(maleic acid).

24. The method of claim 18 wherein abrasion resistant particles comprise inorganic oxide particles or polymer comprised of a greater than 40 percent of a monomer precursor having modulus that is higher than that of polyethylene.

25. The method of claim 24 wherein the abrasion resistant particles comprise polyacrylates, polymethacrylates, cellulose esters, sulfonates, polyesters, polyurethanes, urea resins, melamine resins, urea-formaldehyde resins, polyacetals, polybutyrals, polyvinyl alcohol, epoxies, epoxy acrylates, phenoxy resins, polycarbonates, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, vinylidine chloride-acrylonitrile-acrylic acid copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers.

* * * * *